United States Patent [19]

Seitz

[11] 4,159,794

[45] Jul. 3, 1979

[54] SHEET FEED TRACTOR

[75] Inventor: Alan F. Seitz, Harwinton, Conn.

[73] Assignee: Data Motion Incorporated, Torrington, Conn.

[21] Appl. No.: 847,236

[22] Filed: Oct. 31, 1977

[51] Int. Cl.[2] ..... B65H 17/34

[52] U.S. Cl. ..... 226/75

[58] Field of Search ..... 226/74, 75, 79

[56] References Cited

U.S. PATENT DOCUMENTS

| | | | |
|---|---|---|---|
| 3,477,626 | 11/1969 | Hilpert | 226/74 X |
| 3,926,352 | 12/1975 | Kercher | 226/79 |
| 3,938,721 | 2/1976 | Staneck | 226/75 |

*Primary Examiner*—Richard A. Schacher

[57] ABSTRACT

A drive tractor of the type usually mounted in pairs at opposite edges of a web of edge-perforated sheet material such as printout paper has an endless drive belt mounted on a chassis. The chassis is movably mounted on a base member locked to a support bar. A positioning screw permits fine lateral shifting of th chassis relative to the base member to adjust transverse tension in the web. The drive belt preferably has pins projecting from it to engage edge perforations in the web and is trained over sprocket wheels having teeth which engage a tread on the inner surface of the belt. The sprocket wheel is engaged by a drive shaft. The sprocket teeth and belt tread are respectively configured to mesh only in a selected position of the pins relative to the rotational position of the sprocket wheel. This automatically transversely aligns the pins of paired tractors mounted on a common drive shaft.

18 Claims, 17 Drawing Figures

10
12
14
16
18
20
26
30
34
42
44
52
54
56
56A
56B
58
60
62
62A
62B
64
64A
64B
66
68
70
72
72A
72B
74
76
78
80
82
84
86
88
90
92
94
96
98
100
102
104
104A
106
108
108A
108B
108C
110
110A
110B
110C
112
114
116
118
120
122
124
126
128
134
138
140
142
144
146
154
156
158
160
162
164
168
170
172
184
186

SHEET FEED TRACTOR

BACKGROUND OF THE INVENTION

The present invention concerns, generally, tractors for feeding or advancing web material such as edge perforated webs of paper. As such, the devices of the present invention are especially suited to drive webs of paper such as those employed in computer printout equipment, teletypewriters, optical character readers and the like. However, the tractors are capable of broader application, in general for feeding a web of paper-like material in either continuous web or individual sheet form.

Devices adapted to this purpose are, of course, old and well-known in the art. Generally, such tractors include an endless belt trained in a loop over sprocket wheels which are driven by a drive shaft of the equipment (printer, etc.) on which the tractor is mounted. The belt typically has pins projecting from it to engage perforations provided in the paper or other material to drive the material along a linear path. The belt is trained over supports to curve away from the linear path and then return along the loop back to the linear path. Such tractors are normally employed in pairs at opposite edges of the web of material to drive it from both its opposite edges.

One problem associated with such prior art devices is that of maintaining proper tension across the web transversely of its drive direction. This requires precise positioning of the paired tractors laterally of the web. Generally, the prior art has attempted to deal with this problem by shifting the tractors along a support rod on which they are mounted. U.S. Pat. No. 2,140,028 discloses a device in which rotation of a crank turns a threaded shaft to shift paired tractors to adjust the spacing between them. Both tractors are shifted simultaneously by moving the entire tractor along the shaft. U.S. Pat. 3,006,520 shows a somewhat similar device in which the tractors may be shifted individually or simultaneously. U.S Pat. No. 1,938,531 shows a similar concept employed on a typewriter and U.S. Pats. 2,278,565; 3,115,491; 3,152,742; 3,154,235' and 3,688,959 show various means to facilitate such lateral shifting of tractors.

All of these devices involve shifting the entire tractor, are difficult and in some cases impossible of providing such shifting during operation, and do not provide for very small increments of shifting.

Another difficulty associated with prior art devices is that if the drive tractor is to be shifted the operator must do so by either unlocking the tractor mount and attempting to reposition the tractor by hand in the case of slide-mounted tractors; or by advancing the tractor along a threaded shaft as by turning a crank, in the case of threaded-shaft mounted tractors. In the latter case, the threads must be coarse enough to move the tractors at a reasonable rate of speed for initial positioning and therefore fine adjustments of position which require a fine threaded shaft, are not readily attainable. In the former case, accurate hand positioning is difficult particularly if the web material is engaged with the drive tractors while the adjustment is being attempted to adjust web tension.

It is accordingly an object of the present invention to overcome the foregoing and other shortcomings of the prior art by providing a novel drive tractor construction and a novel assembly for driving web material.

It is another object of the present invention to provide a novel and efficient drive tractor construction which permits lateral shifting of individual tractors in exceedingly small increments without necessity of shifting the entire tractor on its support rod.

It is another object of the present invention to provide a novel drive tractor as described above and a novel assembly for driving web material including at least a pair of such drive tractors having a base member lockable upon an elongated support bar and a chassis movable on the base member.

Other objects and advantages of the present invention will become apparent from the following description thereof.

SUMMARY OF THE INVENTION

In accordance with the present invention there is provided a drive tractor adapted to be engaged by a drive member for driving web material. The drive tractor comprises a base member having guide means and base mounting means for locking the base member on a support. A chassis is movably mounted on the base member, the chassis having tracking means engaged with the guide means for movement therealong. Web driving means are movably mounted on the chassis and adapted to be operatively connected to a drive member to be driven thereby in a path of travel, the web driving means including web engaging means thereon adapted to engage a web material for driving thereof along a portion of the path of travel defining a drive path extending transversely of the base member guide means. Positioning means are operatively connected to the chassis and the base member to selectively laterally shift the chassis relative to the base member and the drive path, the tracking means following the base member guide means whereby shifting of the chassis and thereby of the web engaging means is guided transversely of the drive path.

In one aspect of the invention, the said drive path extends perpendicularly of the base member guide means whereby the shifting of the chassis and thereby of the web engaging means is guided perpendicularly of the drive path.

Certain objects of the invention are attained when the web driving means comprises a drive wheel mounted for rotation on the chassis and a flexible endless belt having an outer driving surface and an inner driven surface; the web engaging means comprising a plurality of pin members spaced apart along the length of the belt and projecting outwardly of the outer driving surface thereof, and the belt inner driven surface is engaged by the drive wheel for driving the belt to move the pin members in the path of travel including the drive path. The guide means preferably extends perpendicularly to the drive path in such arrangement, whereby the shifting of the chassis and thereby of the pin members is guided perpendicularly of the drive path.

Certain objects of the invention are also attained when the guide means comprises at least one, and preferably a pair of parallel spaced apart, shaft element(s), the tracking means comprises corresponding passage(s) formed in the chassis and dimensioned and configured to slidably receive the shaft element(s) respectively therein. The positioning means preferably comprises a threaded shaft having a turnbuckle nut threadably mounted thereon for rotation for axial movement of the shaft relative to the turnbuckle nut, the turnbuckle nut being engaged with one of the chassis and the base member. The threaded shaft further has a base end affixed to the other of the chassis and base member, whereby rotation of the turnbuckle nut about the shaft shifts the chassis relative to the base member. Preferably, the turnbuckle nut is mounted for rotation on the base member and the shaft base end is affixed to the chassis.

Certain objects of the invention are attained by providing an assembly for driving web material including a pair of drive tractors, each drive tractor being comprised as described in the first paragraph of this Summary of the Invention, the drive tractors being spaced apart with their respective web engaging means being adapted to engage the associated web material adjacent opposite edges thereof.

The assembly of the invention may include as the support an elongated support bar extending parallel to the guide means, and the means for locking the base members on the support includes a bore extending through the respective base members, the support bar being slidbly received within the bores for slidable movement of the base member therealong to respective selected spaced apart positions along the support bar, and the positioning means are adapted to shift their respective chassis relative to the selected positions in a direction parallel to the support bar.

DESCRIPTION OF THE PREFERRED EMBODIMENTS

Figures 1, 1A:
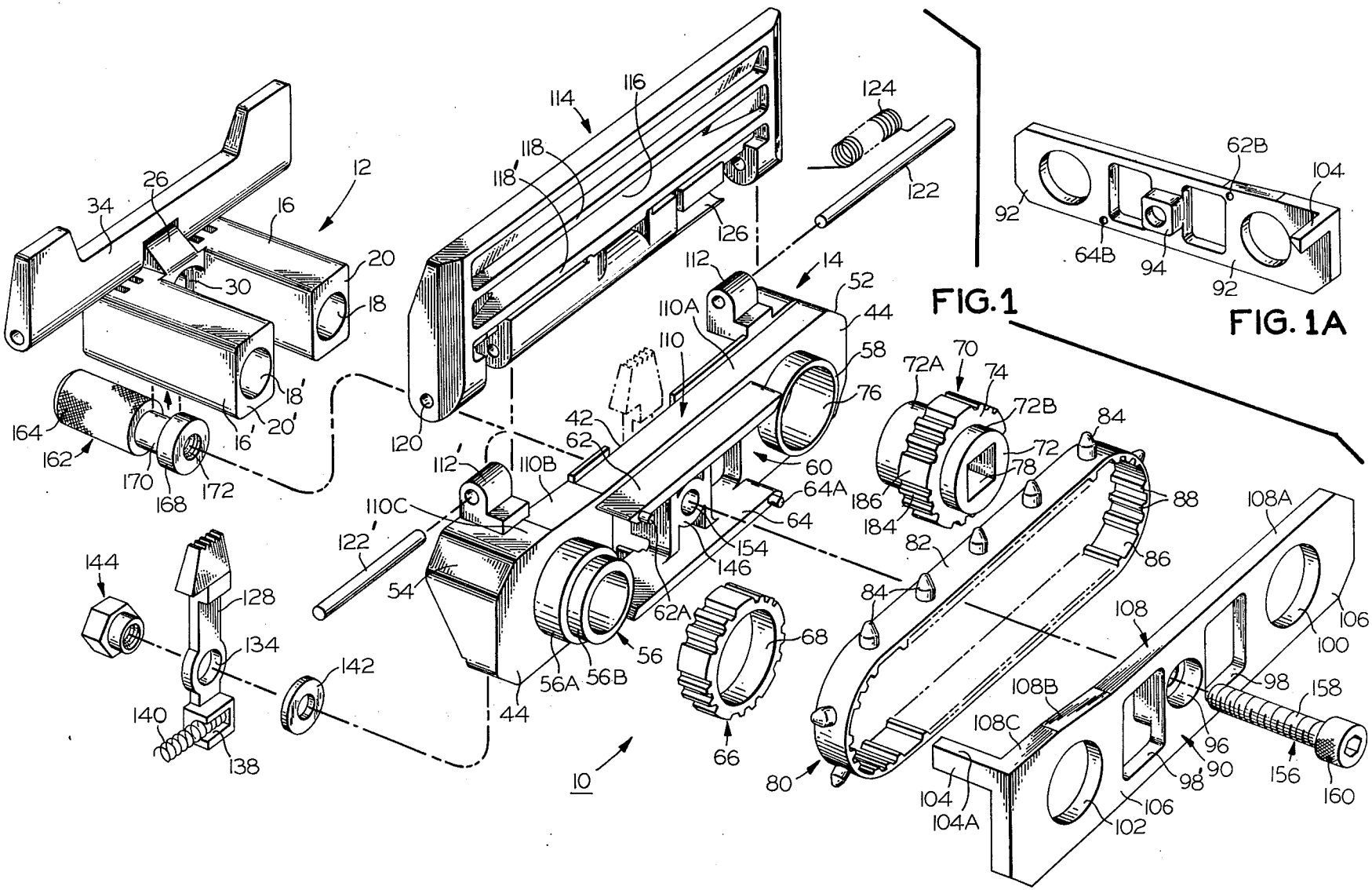
FIG. 1 is an exploded perspective view of one embodiment of a drive tractor in accordance with the present invention.
FIG. 1A is a perspective view of a component of the assembly of FIG. 1 showing its side opposite to that shown in FIG. 1.
Figure 4:
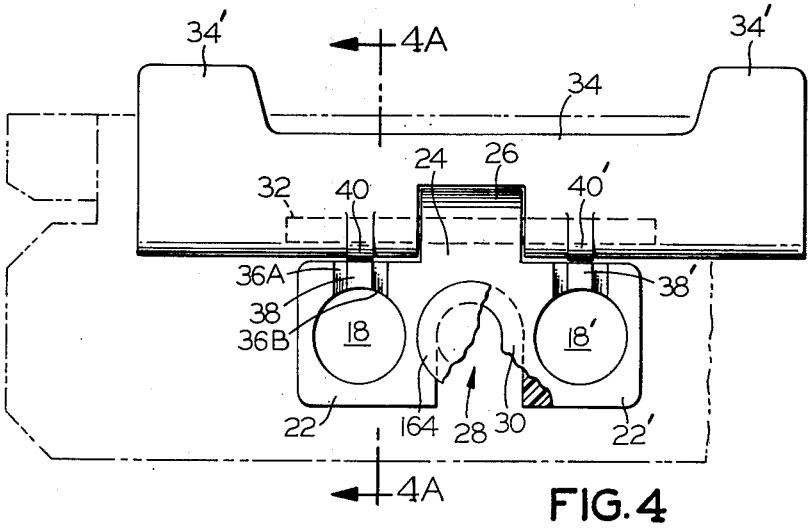
FIG. 4 shows the base member omitted from FIG. 3 in the same perspective as it would be viewed in FIG. 3, the base member being shown with its locking tab in the unlocked position, the portion of the device shown in FIG. 3 being partially indicated in dot-dash outline in FIG. 4.
Figure 4A:
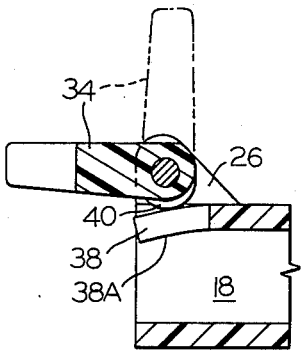
FIG. 4A is a section view in elevation along line 4A—4A of FIG. 4 showing the locking tab in solid line in its locked position and in dot-dash line in its unlocked position.

FIG. 1 shows, in exploded view, a drive tractor, generally indicated at 10 including a base member 12 and a chassis 14. Base member 12 has a generally U-shaped configuration. The various components are assembled as indicated by the dot-dash lines in FIG. 1. Base member 12 is comprised of guide means comprising a pair of parallel spaced apart shaft elements 16, 16' each of which is generally rectangular in cross section but having somewhat rounded corners. Each shaft element 16, 16' has a central bore 18, 18' formed therein and extending longitudinally of shaft elements 16, 16' and passing completely therethrough from front faces 20, 20', which comprise the forward end of base member 12, to rear faces 22, 22' (FIG. 4) which comprise the trailing end of base member 12. As best appreciated by referring jointly to FIGS. 1, 4 and 5, shaft elements 16, 16' are joined at the trailing end of base member 12 by a connecting web portion 24 which terminates at its upper end in a hinge block 26 of generally triangular shape, as best seen in FIG. 4A. As best seen by referring jointly to FIG. 4 and drive tractor 10 in FIG. 5, connecting web portion 24 has an arch shaped opening 28 formed therein which is undercut to provide an inverted U-shaped lip 30 therearound to seat a rotatable threaded member as described in more detail below.

Hinge block 26 has a bore (unnumbered) formed therein extending in a direction perpendicular to the longitudinal axes of shaft elements 16, 16' to receive therein a lock hinge pin 32. An elongated locking tab 34 is of generally planar construction having a central cutout portion (unnumbered) sized to fit over hinge block 26 and having bores (unnumbered) extending longitudinally adjacent the hinged portions thereof to receive opposite end segments of lock hinge pin 32, as best shown in FIGS. 4 and 4A. A shallow U-shaped cutout portion at the free edge of locking tab 34 provides a pair of ears 34'.

At the rear faces 22, 22' of base member 12 a pair of parallel slots 36A, 36B are cut into the topmost surface of shaft element 16 and extend into central bore 18. As best seen in FIG. 1, slots 36A, 36B (unnumbered in FIG. 1 for clarity of illustration) extend for a short distance along the longitudinal axis of shaft element 16 to provide a projecting tab 38 extending along an upper, trailing end portion of central bore 18. An identical projecting tab 38 is provided above central bore 18' by identically configured slots (unnumbered).

As shown in FIGS. 4 and 4A a pair of bosses 40, 40' are formed adjacent hinged edge 34A of locking tab 34. Bosses 40 are configured and sized so that with locking tab 34 in its vertical open position illustrated in dot-dash line in FIG. 4A, projecting tab 38 (and projecting tab 38') is not forced downwardly by boss 40 but is in its free position with its lower surface 38A forming part of the cylindrical inner surface of bore 18. However, with locking tab 34 rotated to the horizontal position shown in solid line in FIG. 4A, boss 40 biases locking tab 38 downwardly to provide a locking action on a rod journaled within bore 18 as described more fully hereinbelow. The identical action is provided by boss 40' on tab 38'.

Chassis 14 is of elongated construction and includes a chassis frame 42 which has a first sidewall portion 44 of planar configuration extending from feed end 46 to discharge end 48 (FIG. 2) of tractor 10.

Figure 3:
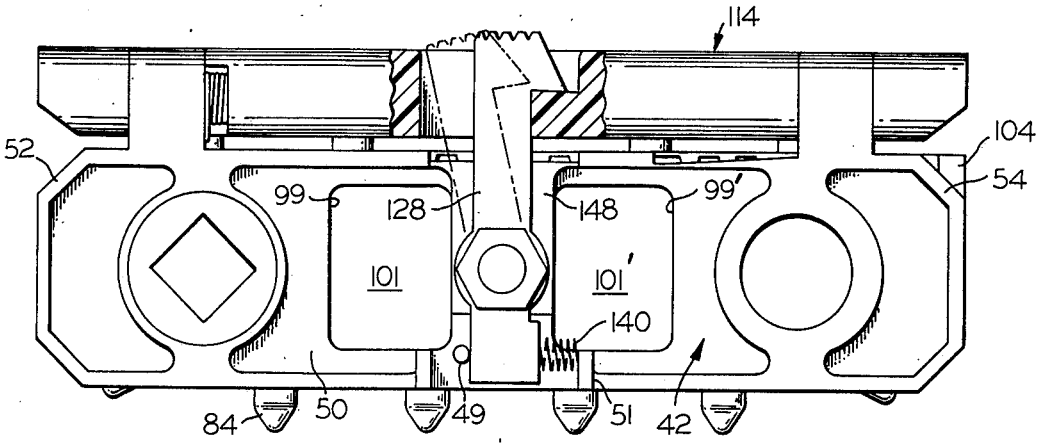
FIG. 3 is a side view in elevation of the tractor of FIG. 1, showing its side opposite to that shown in FIG. 2 and with its cover in the closed position and partially broken away, and its base member omitted for clarity of illustration.

Referring jointly to FIGS. 1 and 3, chassis frame 42 is seen to be of generally beam-like construction having a web portion generally indicated at 50 in FIG. 3 from which laterally projects a flange-like feed end shoulder 52 and a discharge end shoulder 54. Planar first sidewall portion 44 is provided by the side of web portion 50 opposite that from which shoulders 52, 54 project. An idler wheel bearing 56 projects outwardly of first sidewall portion 44. Idler wheel bearing 56 is in the form of a hollow cylinder having a stepped outer surface so that the outer diameter of the cylinder is larger at the base 56A projecting from first sidewall portion 44 than it is at the top 56B, as best seen in FIG. 1. A drive sprocket bearing 58 in the form of a simple hollow cylinder is provided at the end of chassis frame 42 adjacent feed end shoulder 52. Extending longitudinally between idler wheel bearing 56 and drive sprocket wheel bearing 58 is a belt support means 60 comprising a belt drive support element 62 and a belt return guide element 64. Support elements 62 and 64 are spaced apart from each other sidewise of chassis frame 42 and have respective assembly pins 62A, 64A projecting laterally from their side edges.

A toothed idler wheel 66 has an inner bearing portion 68 adapted to fit over idler wheel bearing 56 to be rotatably mounted thereon.

A toothed drive sprocket wheel 70 has a central cylindrical portion on which is formed a ring 74 having the sprocket teeth formed therein. Cylindrical portion 72 projects beyond opposite sides of ring 74 and cylindrical outer surface 72A is sized to be rotatably received within inner bearing portion 76 of sprocket wheel bearing 76 of sprocket wheel bearing 58. A shaftway 78 of square cross section extends longitudinally through cylindrical portion 72 from one end thereof to the other. Thus, idler wheel 66 is adapted to be mounted for rotation on bearing 56 and sprocket wheel 70 is adapted to be mounted for rotation on bearing 58.

An endless belt 80 is made of a flexible material and is adapted to be trained over wheels 56 and 70 in a loop. Belt 80 has an outer driving surface 82 from which a plurality of web engaging means comprising pins 84 project. Pins 84 are spaced apart along the length of belt 80 and project perpendicularly outwardly of driving surface 82 thereof. Pins 84 are centered on the longitudinal center line of driving surface 82 and are spaced apart equally along the length thereof. Inner driven surface 86 of belt 80 has a plurality of belt teeth spaced apart along the length thereof and extending transversely across surface 86. Inner driven surface 86 is adapted to mesh with the teeth of wheel 66 and 70 to drive belt 80.

A chassis plate 90 is of elongated generally planar construction and, as shown in FIG. 1A, has an inner side thereof comprising a planar second sidewall portion 92 in which are formed a pair of apertures 62B, 64B which are adapted to lockingly engage assembly pins 62A, 64A, respectively so as to securely mount chassis plate 90 upon chassis frame 42. Still referring to FIG. 1A, a raised land portion 94 of generally square periphery is seen to be formed on second sidewall portion 92 and projects laterally outwardly thereof. Land portion 94 has a bore 96 (FIG. 1) of circular cross section extending therethrough and through chassis plate 90. Spaced longitudinally apart on either side of land portion 94 are a pair of passage openings, 98, 98' (FIG. 1) of generally rectangular cross section but having rounded or fillet corners. Passage openings 98, 98' are dimensioned and configured to receive therein for easy sliding passage therethrough shaft elements 16, 16'. Longitudinally spaced apart on opposite sides of openings 98, 98' are sprocket wheel opening 100 and idler bearing opening plate 102. Wheel opening 100 is circular in shape and is adapted to receive rotatably therein outer surface 72B of center cylindrical portion 72 of sprocket wheel 70. Similarly, idler bearing opening 102 is circular in shape and is adapted to rotatably receive therein outer surface 56B, the reduced diameter portion of idler wheel bearing 56. The cylindrical outer surface 56A of the large diameter portion of bearing 56 is adapted to receive idler wheel 66 rotatably thereon as indicated above.

Chassis plate 90 has a parting arm 104 (FIG. 1) formed at its end thereof which is adapted to be positioned adjacent to discharge end shoulder 54 of chassis frame 42. Parting arm 104, as best seen in FIG. 1A, is triangular in cross section and, when chassis plate 90 is mounted upon chassis frame 42, extends entirely across the gap provided between plate 90 and frame 42 as described more fully hereinbelow. Outside wall 106 of chassis 90 is disposed opposite to second sidewall portion 92.

Chassis plate 90 has a top surface 108 which has an initial horizontal segment 108A and rises in a slanted intermediate segment 108B to a higher elevation segment 108C which is contiguous with and at the same elevation as the top surface of parting arm 104.

Figure 2:
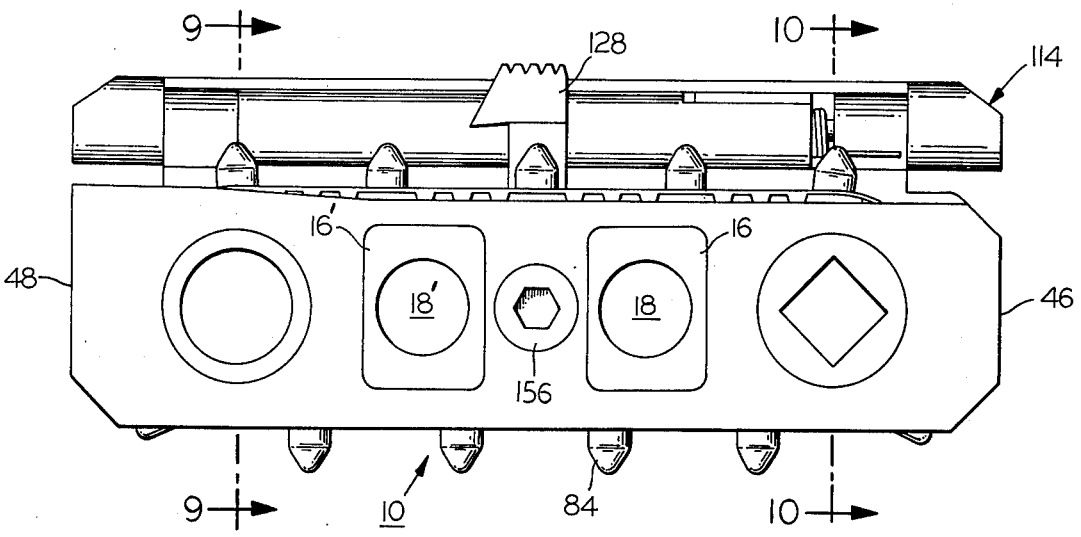
FIG. 2 is a side view in elevation of the assembled tractor of FIG 1 with its cover in the open position.

Chassis frame 42 has a top surface 110 which has a horizontal segment 110A, an upwardly slanted segment 110B and a higher horizontal surface 110C which is at the same elevation as surface 108C. As described in more detail below, when chassis plate 90 is assembled to chassis frame 42, top surfaces 108 and 110 cooperate to define therebetween a pair of spaced apart top surfaces which cooperate to form a surface which rises from below driving surface 82 of belt 80 to a level above it in moving from feed end 46 to discharge end 48 of tractor 10 (FIG. 2).

Figure 5:
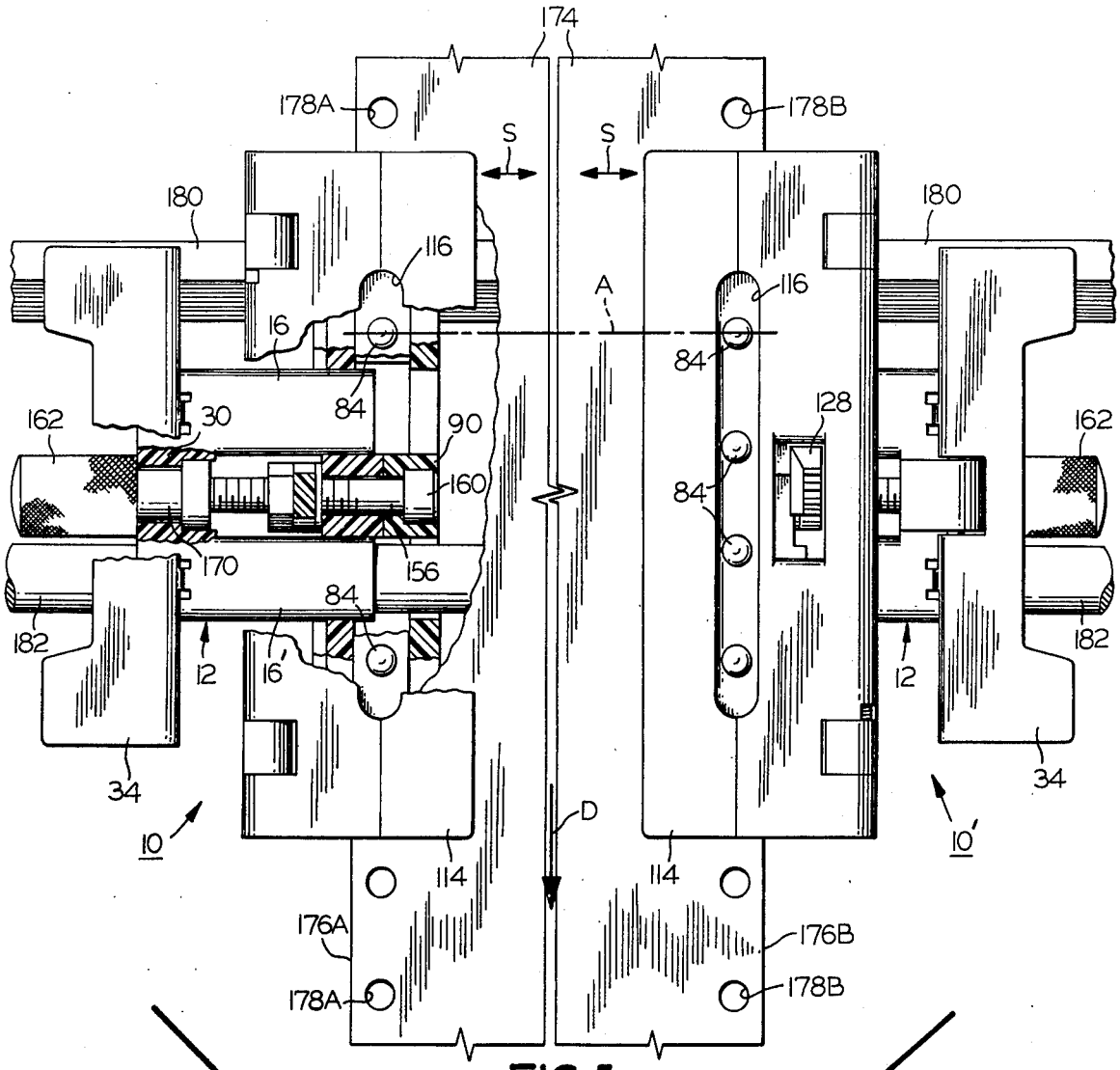
FIG. 5 is a top plan view of a pair of drive tractors engaging opposite edges of a web of paper, the drive tractor at the left hand side of FIG. 5 being that of FIG. 1 and the drive tractor at the right hand side of FIG. 5 being an otherwise identical tractor of opposite hand.

A pair of hinges 112, 112' are formed atop chassis frame 42, on respectively, the top surfaces of shoulders 52, 54. Hinges 112, 112' are longitudinally spaced apart along the longitudinal or first dimension of chassis frame 42. Hinges 112, 112' each contain a bore (unnumbered) passing therethrough parallel to the longitudinal axis of chassis frame 42. A cover plate 114 is generally rectangular in shape and has a central, longitudinal slot 116 formed therein as best seen in FIGS. 1 and 5. FIG. 5, as previously indicated, shows a pair of drive tractors 10 and 10'. Drive tractor 10' is identical to drive tractor 10 except that it is of the opposite hand. Accordingly, corresponding parts of the two drive tractors are identically numbered.

Cover plate 114 has formed on the underside thereof longitudinally extending bearing surfaces 118, 118' extending along opposite edges of slot 116. A longitudinally extending bore 120 extends through cover plate 114 parallel to and adjacent hinge edge 114A and is aligned with the bores formed in hinges 112, 112' so that cover plate hinge pins 122, 122' may be inserted therein to mount cover plate 114 for hinged rotation about chassis frame 42. A torsion spring 124 encircles cover plate hinge pin 122 and is received within a torsion spring retaining compartment 126 formed in cover plate 114 to spring bias cover plate 114 towards its open position illustrated in FIG. 7A.

Figure 6A:
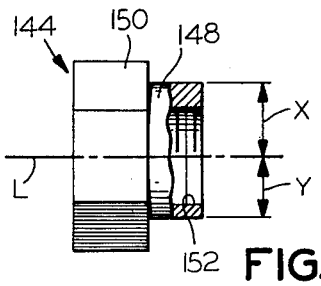
FIG. 6A is an enlarged view of the bearing nut component of the assembly shown in FIG. 6.
Figure 6:
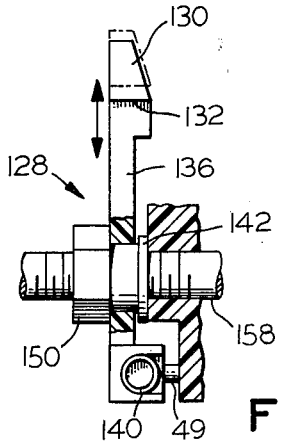
FIG. 6 is a partial view in elevation of the cover latch of the drive tractor of FIG. 1.

A cover latch 128, as shown in FIGS. 1 and 6, has a catch portion 130 having a lip 132 formed at the lower portion thereof. A central bearing retainer socket 134 of circular cross section is formed in body portion 136. At the lower end of cover latch 128 a compression spring retaining compartment 138 is formed to receive therein one end of a compression spring 140. A washer 142 and a bearing nut 144 are employed to mount cover latch 128 on chassis frame 42. For the purpose, chassis frame 42 has a latch mounting pier 146 formed therein between passage openings 98 and 98'. Bearing nut 144 is shown in enlarged view with parts broken away in FIG. 6A and is seen to comprise a cylindrical bearing portion 148 affixed to a conventional hexagonal nut 150. A central internally threaded bore 152 extends longitudinally through bearing nut 144 from one end thereof to the other. The bearing portion 148 is eccentrically mounted relative to nut 150 so that the distance X (FIG. 6A) between longitudinal center line axis L of nut 150 and one portion of cylindrical bearing portion 148 is greater than the distance Y from longitudinal axis L to a diametrically opposite portion of the outer surface of cylindrical bearing 148. This arrangement permits adjusting the height of lip 132 of cover latch 128 by rotating bearing nut 144 as will be described hereinbelow in greater detail. Latch mounting pier 146 has a central circular cross section bore 154 formed therein and extending therethrough.

Positioning means are provided by the combination of a threaded shaft 156 and turn-buckle 162. Shaft 156 has a threaded shank 158 and an enlarged head 160 which is adapted to be seated within counterbored passage opening 98.

Turn-buckle 162 has a knurled barrel portion 164 separated from a disc shaped face portion 168 by a longitudinally extending cylindrical neck portion 170. Both barrel portion 164 and face portion 168 has substantially cylindrical outer surfaces and are of equal cylindrical diameter. Neck portion 170 also has a cylindrical shaped outer surface area but one of lesser cylindrical diameter than that of portions 164, 168. The shoulder portions separating barrel portion 164 and face portion 168, respectively, from narrowed neck portion 170 are disposed perpendicularly to the longitudinal central axis of turn-buckle 164. An interiorly threaded turn buckle bore 172 extends longitudinally through turn buckle 162 for almost the entire length thereof, commencing at face portion 168 and stopping short of the opposite end of turn-buckle 162. Turn-buckle bore 172 is threaded to threadably rotatably engage threaded shank 158 of threaded shaft 156. As shown in FIG. 5 with reference to drive tractor 10, narrowed neck portion 170 is adapted to be rotatably seated within U-shaped lip 30 of connecting web portion 24. To assemble a drive tractor from its component parts it is necessary only to slip idler wheel 66 and drive sprocket wheel 70 over their respective bearings 56, 58 and train belt 80 over wheels 66 and 70 with belt teeth 88 meshed with the teeth on wheels 66 and 70. Chassis plate 90 is then mounted upon chassis frame 42 by engagement of assembly pins 62A, 64A with respective apertures 62B, 64B. Cover plate 114 mounted to chassis frame 42 by means of cover plate hinge pins 122, 122' which are passed, respectively, through bore 120 and the bores (unnumbered) in hinges 112, 112'. Torsion spring 124 is emplaced and the opposite legs thereof seat, respectively, against cover plate 114 and hinge 112. Cover latch 128 is mounted on chassis frame 42 with compression spring 140 having one end received within its retaining compartment 138 and its opposite end abutted against a vertically extending flange 51 projecting outwardly of web portion 50, as best seen in FIG. 3. A retaining pin 49 projects outwardly of web portion 50 adjacent the lower end of cover latch 128. Compression spring 140 is thus compressed between hinge 51 and retaining compartment 138. Retaining pin 49 serves to provide a stop for pivoting movement of latch 128 about its cylindrical bearing portion 148.

As shown in FIG. 3, chassis frame 42 is provided with frame passage openings 99, 99' which are substantially identical configuration as passage openings 98, 98' of chassis plate 90. With chassis plate 90 mounted to chassis frame 42 passages 98, 99 and 98', 99' are in axial alignment and together cooperate to provide tracking means comprising a pair of passages 101, 101' (FIG. 3). Shaft 156 is threaded through chassis frame 42 and plate 90.

Body portion 12 is mounted upon chassis 14 by passing shaft elements 16, 16', respectively, into passages 101, 101' for sliding movement therein. The outer surfaces of shaft elements 16, 16' are configured to closely but slideably pass within passages 101 and 101' and to be constrained for linear sliding movement therein.

Threaded shaft 156 is then passed through bore 96, bore 154 and extends between shaft elements 16 and 16', as may best be seen in FIG. 5 with respect to tractor 10 thereof. Turn-buckle nut 162 is seated upon lip 30 and the end of threaded shaft 156 opposite its head 160 is threadably engaged with turn-buckle bore 172.

Assembled tractor 10 is now ready for placement upon a support means. Referring now to FIG. 5, tractor 10 is in plan view with parts broken away for ease of illustration. A paper web 174 has central portion of it omitted. It will be appreciated by those skilled in the art that paper web 174 may be any web material but is normally a computer paper of, e.g., 38 cm. width ($14\frac{3}{4}$ inches) having opposite edge portions 176A, 176B. A series of perforations 178A, 178B are provided in a single longitudinally extending line adjacent, respectively, opposite edge portions 176A, 176B. For computer printout paper, typically, the center line of the perforations are 0.635 cm ($\frac{1}{4}$ inch) in from the respective edge portions of the paper and the perforations are spaced apart in the line of perforations 1.270 cm ($\frac{1}{2}$ inch) center to center. The diameter of the perforations is 0.404 cm (0.159 inch). Opposite edges of paper web 174 are gripped by tractors 10, 10' for driving of web 174 in the direction indicated by the arrow D in FIG. 5.

Figure 5A:
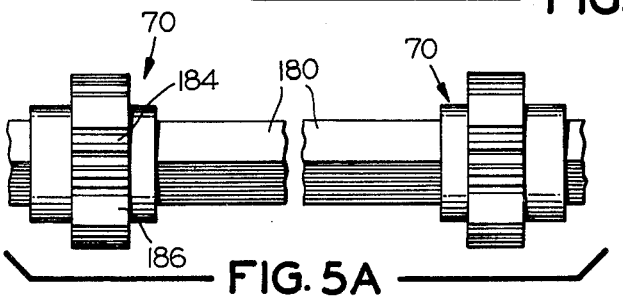
FIG. 5A is a top plan view with parts broken away of the respective drive sprockets of the two drive tractors shown in FIG. 5.
Figure 7:
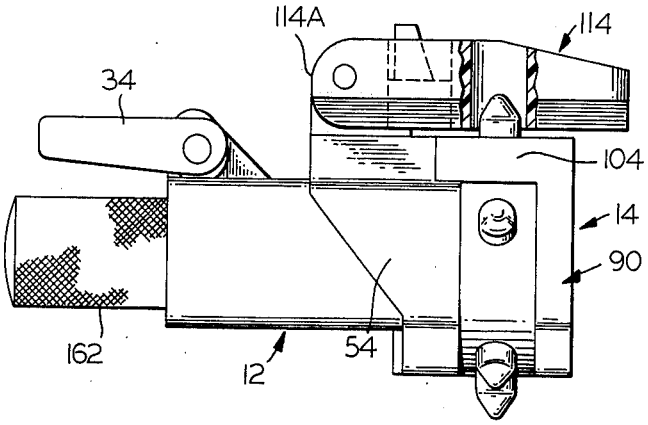
FIG. 7 is an end view in elevation of the tractor of FIG. 1 showing its cover in the closed position.
Figure 7A:
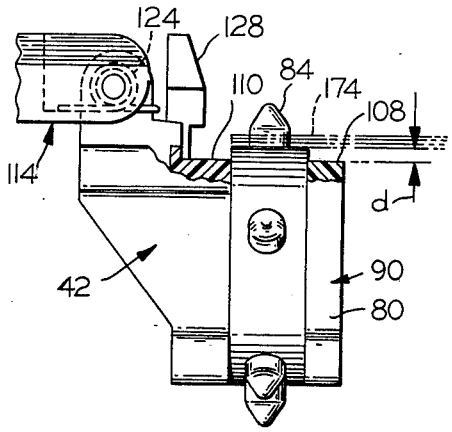
FIG. 7A is a view corresponding to FIG. 7 but with parts broken away and showing the cover in its open position with a plurality of webs of paper material indicated in dot-dash line.
Figure 8:
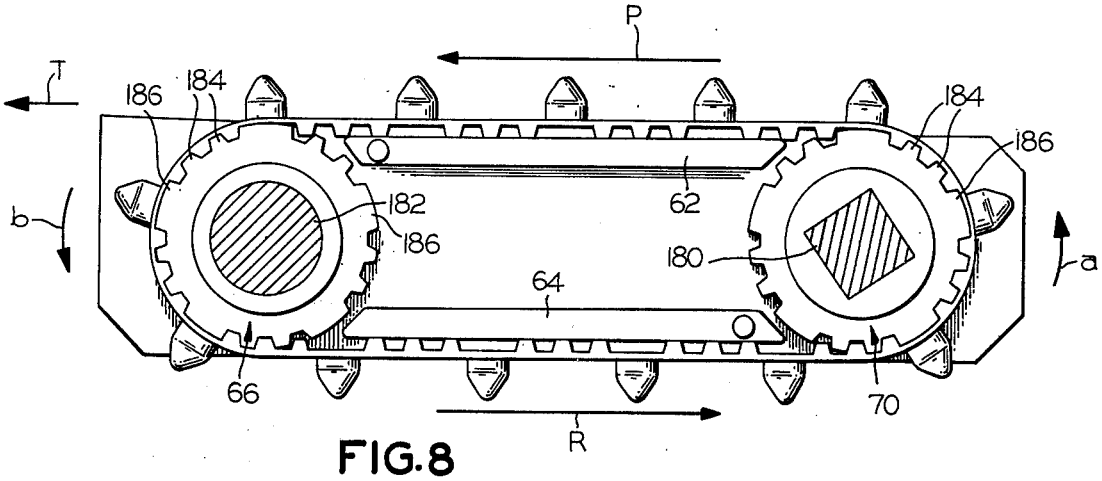
FIG. 8 is a view corresponding to that of FIG. 2 but with parts omitted for clarity of illustration and showing the device mounted on a support rod and engaged with a drive shaft as shown in FIG. 5.
Figure 11:
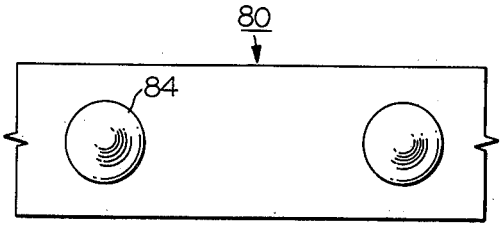
FIG. 11 is a partial plan view on an enlarged scale of a segment of the drive belt of the tractor of FIG. 1.
Figure 12:
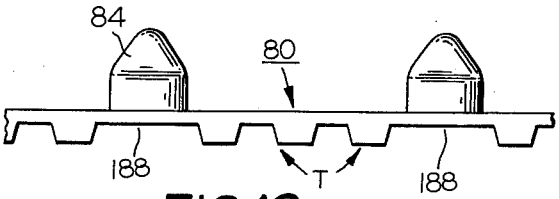
FIG. 12 is a side view in elevation of a segment of the belt of FIG. 11.

As hereinabove indicated, drive tractor 10' is identical to drive tractor 10 described above, except that it is of the opposite hand with respect, for example, to the configuration of top surfaces 108, 110 so that the two drive tractors may drive from opposite edges of web 174. Referring to FIGS. 5 and 5A, a drive shaft 180 has a square cross section and is suitably journaled at its opposite ends (not shown) and connected to be rotated by a suitable electric motor or the like to provide power to drive tractors 10 and 10' as is well known in the art. As is also well known in the art, a support rod 182 of circular cross section extends parallel to and substantially coextensively with drive shaft 180. Support rod 182 is associated with the printing or other equipment of which drive shaft 180 is a part. As is well known in the art, the provision of such support rods 182 is a common expedient to provide seating for drive tractors 10, 10' which are mounted thereon by seating one of central bores 18, 18' onto support rod 182 for sliding movement thereover. As seen in FIG. 8, the outer surface of support rod 182 is sized and configured to receive inner surface of, in the case of tractor 10, bore 18' thereover in closely fitting but slideable engagement therewith. tractor 10' is similarly mounted on support rod 182 and the two tractors are slid apart on the support rod until they are approximately separated by the required distance to align perforations 178A, 178B with pins 84 of the respective belts 80. When tractors 10, 10' are in their approximate position, locking tab 34 is flipped downwardly into its horizontal position which causes bosses 40 to deflect projecting tabs 38, 38' downwardly as shown in FIG. 4A. This securely locks base members 12 in spaced apart relationship to a common supporting rod 182. Obviously, depending on the configuration of the particular type machine employed, support rod 182 may comprise two separate stub rods. However, normally, elongated support rods are provided so that the paired tractors may be slid therealong to the desired distance apart from each other. This arrangement, which is well known and understood to those skilled in the art, is illustrated in FIG. 5A in which the respective sprocket wheels are drivingly engaged by a common drive shaft 180. By virtue of the square cross section of drive shaft 180 and the complementary square cross section of shaftway 78 of drive sprocket wheel 70, rotation of drive shaft 180 by suitable motor or other means (not shown) likewise rotates each of sprocket wheels 70. FIG. 5 thus illustrates an assembly for driving web material which includes a pair of spaced apart drive tractors. Referring to FIGS. 8 and 12, belt 80 is seen to be provided on its inner driven surface 86 with a plurality of belt teeth 88, generally indicated at T in FIG. 12, configured to drivingly mesh with the sprocket and idler wheel teeth 184, 186. Belt 80 engages wheels 66 and 70 and drive shaft 180 engages wheel 70. Belt 80 is supported and guided by elements 62 and 64. Rotation of drive shaft 180 rotates sprocket wheel 70 and drives belt 80 along the drive path indicated by the arrow P in which pins 84 of belt 80 are fully engaged with perforations 178A, 178B to drive paper web 174. Paper web 174 is supported on driving surface 82 of belt 80. As belt 80 begins to drive downwardly around idler wheel 66 as indicated by the arrow b, belt 80 separates from paper web 174 which continues, at least momentarily, in the direction of arrow T to be received by another piece of equipment or a storage tray or the like. Belt 80 continues along its return path indicated by the arrow R and curves upwardly around sprocket wheel 70 as indicated by the arrow a. As belt 80 curves upwardly about sprocket wheel 70, pins 84 engage incoming perforations of paper 174. Generally, full engagement of pins 84 with paper web 174 takes place in the drive path which may be considered to be that portion of belt 80 disposed between vertical (as viewed in FIG. 8) center lines passing through the axes of rotation of wheels 66 and 70. Wheels 66, 70 and support element 62 and guide element 64 cooperate to train belt 80 in the form of a loop. As best seen in Figure 7A, side edges of belt 80 are held against shifting by first and second sidewall portions 44, 92. The loop formed by belt 80 is seen to be disposed in a plane perpendicular to the axes of rotation of wheels 66, 70. That is, a plane passed parallel to the longitudinal center line of looped belt 80 is perpendicular to the axes of rotation of wheels 66, 70.

In use, a pair of tractors 10, 10' are mounted at a suitably spaced apart distance on a support rod 182 and locked thereon in place by means of locking tab 34, shaft ways 78 of the respective sprocket wheels 70 being engaged with drive shaft 180. Since both sprocket wheels are identically configured and mounted on the same drive shaft, the teeth 84 of the belts of the respective tractors 10 and 10' are automatically transversely aligned with each other as indicated by the dot-dash line in Figure 5. Therefore, the possibility of operator error and the need to insure alignment before assembling the tractors on the rod and shaft is precluded.

With cover plates 114 in the open position, a web of material such as computer printout paper having edge perforations thereon is placed between the tractors 10 and 10' and the perforations thereof seated upon the pins 84 positioned in the drive path. Cover plates 114 are then closed, latch 128 locking them in place and longitudinally extending bearing surfaces 118 of cover plates 114 maintaining the opposite edge portions of the paper web 174 in place. Rotation of drive shaft 180 now drives sprocket wheels 70 which drives belts 80 to drive paper web 174 in the direction of arrow D in FIG. 5. To adjust transverse tension in the belt, turnbuckle nuts 162 may be rotated selectively in either direction to laterally shift respective ones of chassis 14 laterally relative to its associated base member 12 as indicated by the arrows S in FIG. 5. Threaded shank 158 and the corresponding threads in turnbuckle bore 172 may be made of any selected size. Generally, the threads are of small size so that a fine, vernier-like adjustment is provided. Rotation of turnbuckle nuts 162 provides for a closely controlled lateral shifting of the respective chassis 14 either leftwardly or rightwardly as viewed in FIG. 5 to alternately selectively increase or decrease the transverse tension across paper web 174. Obviously, the lateral shifting also provides for a very fine alignment of pins 184 with the associated perforations 178A and 178B. Thus, both automatic pin alignment in the direction of paper web travel and transverse adjustment of the cross web distance between pins of the paired tractors is provided. In effect, drive tractors in accordance with the invention provide a two-stage mounting of the chassis on the support member, firstly, by providing a base member such as base member 12 which may be moved to any selected location along the support rod locked in place thereon, and then lateral shifting of the chassis relative to the locked base member.

While drive tractors in accordance with the invention may, of course, be made of any suitable material, including metal, e.g., aluminum, it is preferred that the drive tractor be made from a plastic, i.e., synthetic organic polymeric material. In a preferred embodiment, the drive tractor is molded from a polycarbonate material, preferably one admixed with a fluorocarbon material such as that sold under the trademark TEFLON by E.

I. DuPont deNemours and Company. The drive belt is preferably made of a glass-filled polyester material.

Figure 9:
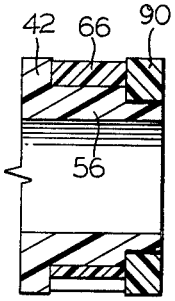
FIG. 9 is a partial section view taken along line 9—9 of FIG. 2.
Figure 10:
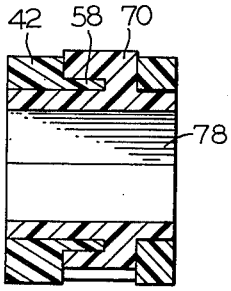
FIG. 10 is a partial section view taken along line 10—10 of FIG. 2.

Modern plastic molding techniques are more than adequate, particularly when utilizing a polycarbonate material, to provide molded parts of sufficiently close tolerance to insure good fit and smooth operation of the drive tractors. In this regard, FIGS. 9 and 10 show in cross sectional view the mounting of, respectively, idler wheel 66 and sprocket wheel 70 to their respective associated bearings. While the bearings and wheels must be made to close tolerances to insure smooth rotation and reduce friction, the design of the preferred embodiment provides that openings 100 and 102 may be made slightly oversized so that the size of these openings need not be held to close tolerances. This reduces the general overall molding cost.

As illustrated in FIG. 7A, top surfaces 108, 110 are, for the major portion of travel of the belt along its limited drive path, recessed below paper webs 174 by the distance d indicated by the dimension arrows in FIG. 7A. This permits paper webs 174, which may be driven in multiple layers as indicated in the dot-dash lines in FIG. 7A, to be firmly seated at the base of pins 84 without interference from the top surfaces. Adjacent the discharge end of the tractors, top surfaces 108B, 108C, 104A, 110B and 110C rise to and beyond driving surface 82 of belts 80 and 104 to insure clean disengagement of paper web 174 with pins 84 of belt 80.

The tractors 10, 10' are provided with double sets of openings therein to receive a support rod and a drive shaft. Normally, one support rod and one drive shaft is engaged with each tractor. Obviously, the tractors may be mounted on double spaced apart support rods. The provision of double passages permits flexibility in positioning the tractors on various pieces of equipment.

To accommodate different layers of web material 174, bearing nut 144, which is threaded on shaft 156, may be turned to raise or lower lip 132 which decreases or increases the bearing pressure imposed by cover 114 on webs 174.

While the invention has been described in detail with respect to a specific illustrated preferred embodiment thereof, it will be apparent to those skilled in the art tha, upon a reading and understanding of the foregoing, numerous alterations and modifications will be made to the specifically disclosed structure which are nonetheless within the spirit of the invention and it is intended to include such alterations and modifications within the scope of the amended claims.

What is claimed is:

1. A self-contained drive tractor adapted to be mounted upon a printer support and engaged by a drive member for driving web material comprising:

(a) an elongated base member having guide means extending transversely thereof and base mounting means for locking said base member on a printer support;

(b) a chassis movably mounted on said base member, said chassis having tacking means engaged with said guide means for movement therealong;

(c) web driving means movably mounted on and contained within said chassis and adapted to be operatively connected to a drive member to be driven thereby in a path of travel, said web driving means including web engaging means thereon adapted to engage a web material for driving thereof along a portion of said path of travel defining a drive path extending transversely of said base member guide means; and (d) threaded positioning means operatively connected between said chassis and said base member to selectively laterally shift said chassis transversely of said base member and said drive path, said tracking means following said base member guide means whereby said shifting of said chassis and thereby of said web engaging means is guided transversely of said drive path.

2. The drive tractor of claim 1 wherein said drive path extends perpendicularly of said base member guide means whereby said shifting of said chassis and thereby of said web engaging means is guided perpendicularly of said drive path.

3. The drive tractor of claim 1 wherein said web driving means comprises a drive wheel mounted for rotation on said chassis and a flexible endless belt having an outer driving surface and an inner driven surface, said web engaging means comprises a plurality of pin members spaced apart along the length of said belt and projecting outwardly of said outer driving surface thereof, said belt inner driven surface being engaged by said drive wheel for driving said belt to move said pin members in said path of travel including said drive path, and said guide means extends perpendicularly to said drive path whereby said shifting of said chassis and thereby of said pin members is guided perpendicularly of said drive path.

4. The drive tractor of claim 3 wherein said belt is disposed in a loop lying in a plane disposed perpendicularly to the axis of rotation of said drive wheel.

5. The drive tractor of claim 4 further including an idler wheel mounted for rotation on said chassis and spaced apart from said drive wheel, said belt inner driven surface being engaged with said idler wheel, said drive wheel and said idler wheel having sprocket teeth formed thereon and said belt inner driven surface having belt teeth formed thereon adapted to be drivingly engaged with said sprocket teeth.

6. A drive tractor adapted to be engaged by a drive member for driving web material comprising:

(a) a base member having guide means and base mounting means for locking said base member on a support, said guide means comprising at least one shaft element;

(b) a chassis movably mounted on said base member, said chassis having tracking means engaged with said guide means for movement therealong, said tracking means comprising a passage formed in said chassis dimensioned and configured to slidably receive therein said shaft element of said guide means;

(c) web driving means movably mounted on said chassis and adapted to be operatively connected to a drive member to be driven thereby in a path of travel, said web driving means including web engaging means thereon adapted to engage a web material for driving thereof along a portion of said path of travel defining a drive path extending transversely of said base member guide means, said drive path extending perpendicularly of said base member guide means whereby said shifting of said chassis and thereby of said web engaging means is guided perpendicularly of said drive path; and (d) positioning means operatively connected to said chassis and said base member to selectively laterally shift said chassis relative to said base member and said drive path, said tracking means following said base member guide means whereby said shifting of said chassis and thereby of said web engaging means is guided transversely of said drive path, said positioning means comprising a threaded shaft having a turnbuckle nut threadably mounted thereon for rotation for axial movement of said shaft relative to said turnbuckle nut, said turnbuckle nut being engaged with one of said chassis and said base member and said threaded shaft further having a base end affixed to the other of said chassis and said base member, whereby rotation of said turnbuckle nut about said shaft shifts said chassis relative to said base member.

7. The drive tractor of claim 6 wherein said guide means comprises a pair of parallel spaced apart shaft elements, said tracking means comprises a corresponding pair of parallel spaced apart passsages adapted to, respectively, receive said shaft elements therein for linear sliding movement of said shaft elements through said passages.

8. The drive tractor of claim 7 wherein said turnbuckle nut is mounted for rotation on said base member and said shaft base end is affixed to said chassis.

9. The drive tractor of claim 7 wherein said base member has a connecting web portion joining said shaft elements at one end thereof.

10. The drive tractor of claim 9 wherein said turnbuckle nut is mounted for rotation on said connecting web portion of said base member and said shaft base end is affixed to said chassis.

11. The drive tractor of claim 6 wherein said means for locking said base member includes a bore extending through said shaft element and adapted to receive the associated support therein.

12. The drive tractor of claim 1 wherein said base member is adapted to be selectively positioned relative to its associated support and locked at its selected position thereon, and said positioning means is adapted to shift said chassis relative to said selected position of said base member.

13. An assembly for driving web material, including a pair of self-contained drive tractors adapted to be mounted upon a printer support, each drive tractor comprising:

(a) an elongated base member having guide means extending transversely thereof and base mounting means for locking said base member on a printer support;

(b) a chassis movably mounted on its respective base member, said chassis having tracking means engaged with said guide means for movement therealong;

(c) web driving means movably mounted on and contained within its respective chassis and adapted to be operatively connected to a drive member to be driven thereby in a path of travel, said web driving means including web engaging means thereon adapted to engage a web material for driving thereof along a portion of said path of travel defining a drive path extending transversely of its respective base member guide means, said respective drive paths being parallel to each other; and (d) threaded positioning means operatively connected between its respective chassis and said base member to selectively laterally shift said chassis transversely of said base member and said drive path, said drive tractors being spaced apart with their respective web engaging means being adapted to engage the associated web material adjacent opposite edges thereof, said tracking means following said base member guide means whereby said shifting of said chassis and thereby of said web engaging means is guided transversely of said drive path.

14. The assembly of claim 13 wherein said drive path extends perpendicularly of its respective base member guide means whereby said shifting of said chassis and thereby of said web engaging means is guided perpendicularly of its respective drive path.

15. The assembly of claim 13 wherein the support is an elongated support bar extending parallel to said guide means, said means for locking said base members on the support includes a bore extending through said base member, the support bar being slidably receivable within said bore for slidable movement of said base member therealong to respective selected spaced apart positions along the support bar, and said positioning means are adapted to shift their respective chassis relative to said selected positions in a direction parallel to the support bar.

16. An assembly for driving web material, including a pair of drive tractors, each drive tractor comprising:

(a) a base member having guide means and base mounting means for locking said base member on a support comprising an elongated support bar extending parallel to said guide means, said means for locking said base members on the support including a bore extending through said base member, the support bar being slidably receivable within said bore for slidable movement of said base member therealong to respective selected spaced apart positions along the support bar, said base member guide means comprising at least one shaft element with said bore extending through said shaft element;

(b) a chassis movably mounted on its respective base member, said chassis having tracking means engaged with said guide means for movement therealong, said tracking means comprising a passage formed in said chassis, said passage being dimensioned and configured to slidably receive said shaft element therein;

(c) web driving means movably mounted on its respective chassis and adapted to be operatively connected to a drive member to be driven thereby in a path of travel, said web driving means including web engaging means thereon adapted to engage a web material for driving thereof along a portion of said path of travel defining a drive path extending transversely of its respective base member guide means, said respective drive paths being parallel to each other; and (d) positioning means operatively connected to its respective chassis and said base member to selectively laterally shift said chassis relative to said base member and said drive path, said drive tractors being spaced apart with their respective web engaging means being adapted to engage the associated web material adjacent opposite edges thereof, said tracking means following said base member guide means whereby said shifting of said chassis and thereby of said web engaging means is guided transversely of said drive path, said positioning means comprising a threaded shaft and a turnbuckle nut threadably mounted thereon for rotation for axial movement of said shaft relative to its respective turnbuckle nut, said turnbuckle nut being engaged with one of said chassis and said base member and said threaded shaft further having a base end affixed to the other of its respective chassis and base member, whereby rotation of said turnbuckle nut about its said shaft shifts said chassis relative to its respective base member, said positioning means being adapted to shift their respective chassis relative to said selected positions in a direction parallel to the support bar.

17. The assembly of claim 16 wherein said guide means each comprise a pair of parallel spaced apart shaft elements, said tracking means each comprise a corresponding pair of parallel spaced apart passages adapted to respectively receive said shaft elements therein for linear sliding movement of said shaft elements through said passages.

18. The assembly of claim 17 wherein said turnbuckle nuts are mounted for rotation on their respective base members and said base ends of said shafts are affixed to their respective chassis.

* * * * *